US006113653A

United States Patent [19]

Ashley et al.

[11] Patent Number: 6,113,653

[45] Date of Patent: Sep. 5, 2000

[54] METHOD AND APPARATUS FOR CODING AN INFORMATION SIGNAL USING DELAY CONTOUR ADJUSTMENT

[75] Inventors: James P. Ashley, Naperville; Weimin Peng, Mundelein, both of Ill.

[73] Assignee: Motorola, Inc., Schaumburg, Ill.

[21] Appl. No.: 09/151,567

[22] Filed: Sep. 11, 1998

[51] Int. Cl.[7] ..... G10L 9/14

[52] U.S. Cl. ..... 784/219; 704/207; 704/216

[58] Field of Search ..... 704/207, 216, 704/219

[56] References Cited

U.S. PATENT DOCUMENTS 5,704,003 12/1997 Kleijn et al. ..... 704/220

OTHER PUBLICATIONS

Dror Nahumi and Willem Bastiaan Kleijn, "An Improved 8 Kb/s RCELP Coder," Proc. IEEE Workshop on Speech Coding for Telecommunications, p. 39–40, Sep. 1995.

*Primary Examiner*—Richemond Dorvil
*Assistant Examiner*—Tālivaldis Ivars Šmits
*Attorney, Agent, or Firm*—Richard A. Sonnentag

[57] ABSTRACT

An open-loop delay contour estimator (204) generates delay information during coding of an information signal. The delay contour is adjusted according to an error minimization criterion on a subframe basis, which allows a more precise estimate of the true delay contour. A delay contour reconstruction block (211) uses the delay information in a decoder in reconstructing the information signal.

21 Claims, 5 Drawing Sheets

-PRIOR ART-

-PRIOR ART-

METHOD AND APPARATUS FOR CODING AN INFORMATION SIGNAL USING DELAY CONTOUR ADJUSTMENT

FIELD OF THE INVENTION

The present invention relates, in general, to communication systems and, more particularly, to coding information signals in such communication systems.

BACKGROUND OF THE INVENTION

Digital speech compression systems typically require estimation of the fundamental frequency of an input signal. The fundamental frequency $f_0$ is usually estimated in terms of the pitch delay $\tau_0$ (otherwise known as "lag"). The two are related by the expression $$\tau_0=f_s/f_0, \quad (1)$$

where the sampling frequency $f_s$ is commonly 8000 Hz for telephone grade applications.

Since a speech signal is generally non-stationary, it is partitioned into finite length vectors called frames (e.g., 10 to 40 ms), each of which are presumed to be quasi-stationary. The parameters describing the speech signal are then updated at the associated frame length intervals. The original Code Excited Linear Prediction (CELP) algorithm further updates the pitch period (using what is called Long Term Prediction, or LTP) information on shorter subframe intervals, thus allowing smoother transitions from frame to frame. It was also noted that although $\tau_0$ could be estimated using open-loop methods, far better performance was achieved using the closed-loop approach. Closed-loop methods involve an exhaustive search of all possible values of $\tau_0$ (typically integer values from 20 to 147) on a subframe basis, and choosing the value that satisfies some minimum error criterion.

An enhancement to this method involves allowing $\tau_0$ to take on integer plus fractional values. An example of a practical implementation of this method can be found in the GSM half rate speech coder, and is shown in FIG. 1. Here, lags within the range of 21 to 22⅔ are allowed ⅓ sample resolution, lags within the range of 23 to 34⅚ are allowed ⅙ sample resolution, and so on. In order to keep the search complexity low, a combination of open-loop and closed loop methods is used. The open-loop method involves generating an integer lag candidate list using an autocorrelation peak picking algorithm. The closed-loop method then searches the allowable lags in the neighborhood of the integer lag candidates for the optimal fractional lag value. Furthermore, the lags for subframes 2, 3, and 4 are coded based on the difference from the previous subframe. This allows the lag information to be coded using fewer bits since there is a high intra-frame correlation of the lag parameter. Even so, the GSM HR codec uses a total of 8+(3×4)=20 bits every 20 ms (1.0 kbps) to convey the pitch period information.

In an effort to reduce the bit rate of the pitch period information, an interpolation strategy was developed that allows the pitch information to be coded only once per frame (using only 7 bits=>350 bps), rather than with the usual subframe resolution. This technique is known as relaxed CELP (or RCELF), and is the basis for the recently adopted enhanced variable rate codec (EVRC) standard for Code Division Multiple Access (CDMA) wireless telephone systems. The basic principle is as follows.

The pitch period is estimated for the analysis window centered at the end of the current frame. The lag (delay) contour is then generated, which consists of a linear interpolation of the past frame's lag to the current frame's lag. The linear prediction (LP) residual signal is then modified by means of sophisticated polyphase filtering and shifting techniques, which is designed to match the residual waveform to the estimated delay contour. The primary reason for this residual modification process is to account for accuracy limitations of the open-loop integer lag estimation process. For example, if the integer lag is estimated to be 32 samples, when in fact the true lag is 32.5 samples, the residual waveform can be in conflict with the estimated lag by as many as 2.5 samples in a single 160 sample frame. This can severely degrade the performance of the LTP. The RCELP algorithm accounts for this by shifting the residual waveform during perceptually insignificant instances in the residual waveform (i.e., low energy) to match the estimated delay contour. By modifying the residual waveform to match the estimated delay contour, the effectiveness of the LTP is preserved, and the coding gain is maintained. In addition, the associated perceptual degradations due to the residual modification are claimed to be insignificant.

But, while this last claim may be true for medium bit rate coders such as the EVRC full rate mode (i.e., 8.5 kbps), it is less apparent for the EVRC half rate mode, which operates at 4.0 kbps. This is because of the relative ability of the fixed codebooks to model the associated inverse error signal. That is, if coding distortions are introduced by inefficiencies in the LTP, and those distortions can be effectively modeled by the fixed codebook, then the net effect is that the distortion will be canceled. So, while the EVRC full rate mode allocates 120 of 170 bits per frame for fixed codebook gain and shape, the half rate mode can afford only 42 of 80 bits per frame for the same. This results in a disproportionate performance degradation due, in part, to the fixed codebook's inability to model the coding distortion introduced by the LTP.

Therefore, there is a need for an improved method of low rate speech coding.

DETAILED DESCRIPTION OF THE PREFERRED EMBODIMENT

Figure 1:
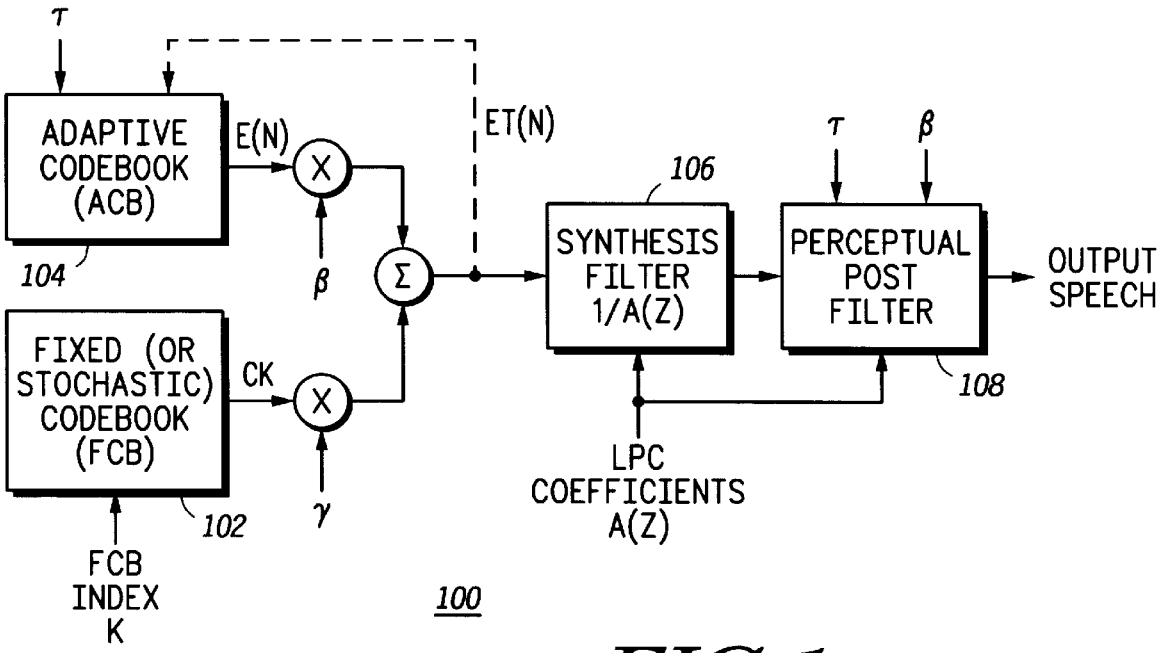
FIG. 1 generally depicts fractional lag values for a GSM half-rate speech coder.

Stated generally, an open-loop delay contour estimator generates delay information during coding of an information signal. The delay contour is adjusted on a subframe basis which allows a more precise estimate of the true delay contour. A delay contour reconstruction block uses the delay information in a decoder in reconstructing the information signal. To further improve sound quality, the delay contour is adjusted to minimize the change in accumulated shift.

Stated more specifically, a method for coding an information signal comprises the steps of dividing the information signal into blocks, estimating the delay of the current and previous blocks of information and forming a delay contour based on the delays of the current and previous blocks of information. The method further includes the steps of adjusting the shape of the delay contour at intervals of less than or equal to one block in length and coding the shape of the adjusted delay contour to produce codes suitable for transmission to a destination.

In the preferred embodiment, the information signal further comprises either a speech or an audio signal and the blocks of information signals further comprise frames of information signals. Also, a linear interpolation between the previous delay and the current delay is used to form the delay contour. The interval of less than one block in length further comprises a subframe in length.

The step of adjusting the shape of the delay contour at intervals of less than or equal to one block in length further comprises the steps of determining the adjusted delay at a point at or between the current and previous delays and forming a linear interpolation between the previous delay point and the adjusted delay point. When determining the adjusted delay point, a change in accumulated shift is minimized. The step of determining the adjusted delay further comprises the step of maximizing the correlation between a target residual signal and the original residual signal. The previous delay point further comprises a previously adjusted delay point. Alternatively, the step of adjusting the shape of the delay contour further comprises the steps of determining a plurality of adjusted delay points at or between the current and previous delays and forming a linear interpolation between the adjusted delay points.

A system for coding an information signal is also disclosed. The system includes an coder which comprises means for dividing the information signal into blocks and means for estimating the delay of the current and previous blocks of information and for forming a delay contour based on the delays of the current and previous blocks of information to adjust the shape of the delay contour at intervals of less than or equal to one block in length to produce delay information for transmission to a decoder.

Within the system, the information signal further comprises either a speech or an audio signal and the blocks of information signals further comprise frames of information signals. The delay information further comprises a delay adjustment index. The system also includes a decoder for receiving the delay information and for producing an adjusted delay contour $\tau_c(n)$ for use in reconstructing the information signal.

Figure 2:
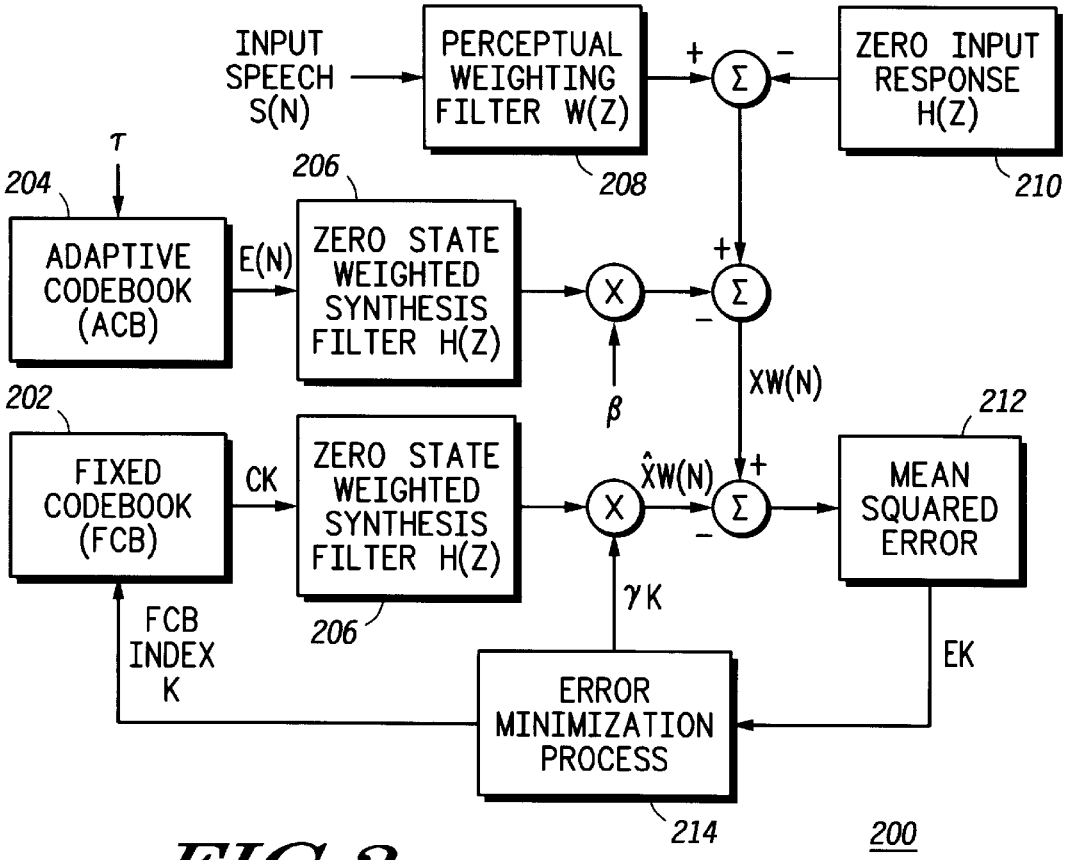
FIG. 2 generally depicts a speech compression system employing delay contour adjustment in accordance with the invention.

FIG. 2 generally depicts a speech compression system 200 employing delay contour adjustment in accordance with the invention. As shown in FIG. 2, the input speech signal s(n) is processed by a linear prediction (LP) analysis filter 202 which flattens the short-term spectral envelope of input speech signal s(n). The output of the LP analysis filter is designated as the LP residual $\epsilon(n)$. The LP residual signal $\epsilon(n)$ is then used by the open-loop lag estimator 204 as a basis for estimating the delay contour $\tau_c(n)$, the open-loop pitch prediction gain $\beta_{ol}$ and delay information to be utilized for delay contour adjustment. The RCELP residual modification process 206 uses this information to map the LP residual to the delay contour, as described above. The modified residual signal is then passed through a weighted synthesis filter 207 before being processed by the long term predictor 208 and eventually by the fixed codebook 210, which characterizes the synthesizer excitation sequence. At the decoder side, the fixed codebook index/gain is input to an excitation generator 212 which outputs an excitation sequence. The delay information is input into delay contour reconstruction block 211 where an adjusted delay contour $\tau_c(n)$ is output. The adjusted delay contour $\tau_c(n)$ output from block 211 is input to a long term synthesis filter 214 which outputs a signal which is then input into a short term synthesis filters 216 to produce the reconstructed speech output in accordance with the invention.

Figure 3:
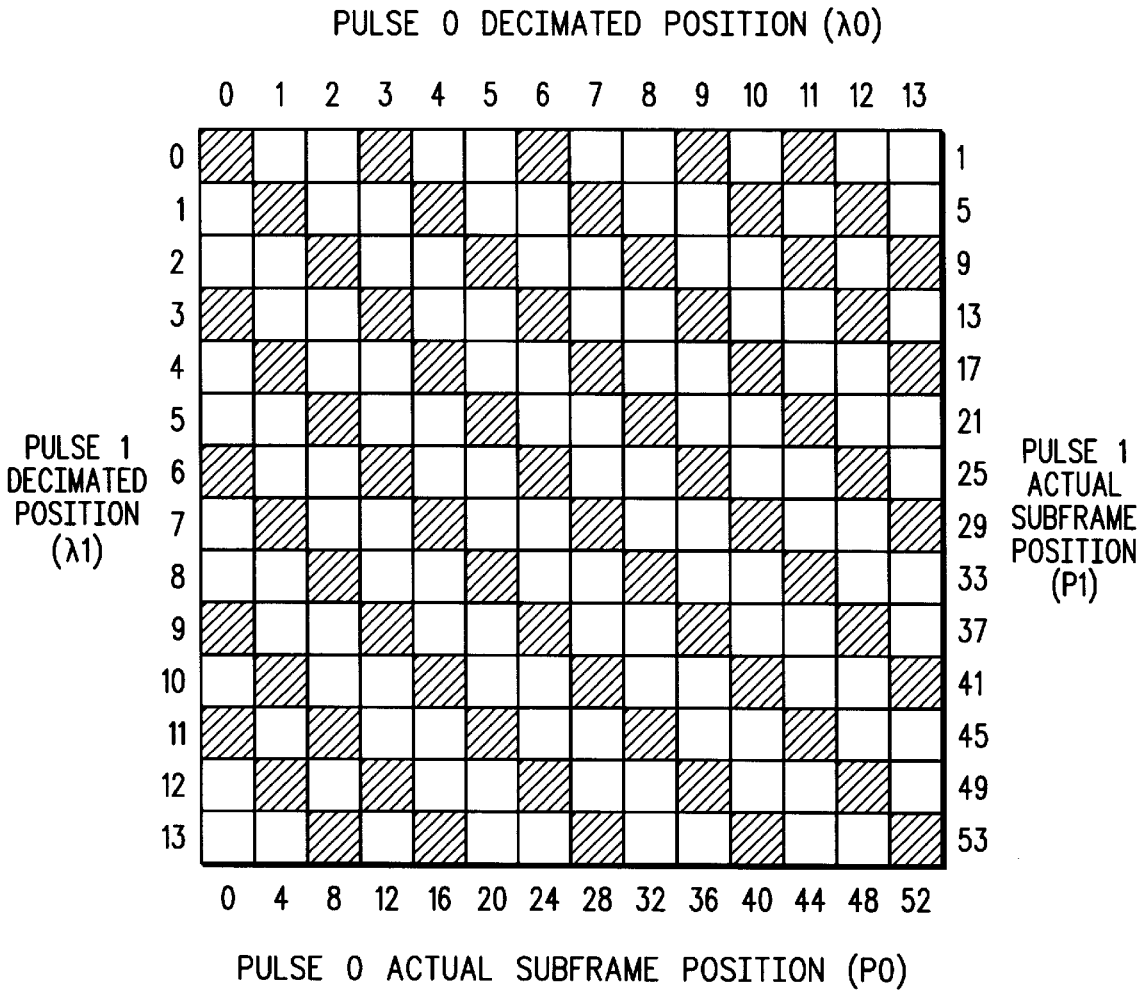
FIG. 3 generally depicts an estimation of delay contour as known in the prior art.

In the prior art, the delay contour $\tau_c(n)$ is estimated by means of a linear interpolation between the estimated delay at the end of the current frame of speech and the delay at the end of the previous frame of speech, as shown in FIG. 3. In order to estimate the delay corresponding to the point at the end of the frame, the pitch analysis frame must be centered about that point. Therefore, one half of the pitch analysis frame must "look-ahead" to the next frame. The pitch analysis frame in this embodiment consists of 160 samples, which corresponds to a look-ahead length of 80 samples (or 10 ms). As is apparent to one skilled in the art, a delay of 80 samples or more may not necessarily be resolved using a 160 sample frame, because at least two full pitch periods are required. Rather than increasing the amount of look-ahead (and subsequently, algorithmic delay), a supplemental pitch window is used that is offset in time from the given pitch window to account estimating longer delays. For the sake of simplicity, however, only the primary pitch analysis windows are shown in FIG. 3.

But even with the interpolated delay contour, one can easily see than the estimate can deviate from the actual delay contour by a substantial margin. During frame m, for example, the estimate of the delay contour is as accurate as possible given the integer endpoint constraints, but as can be seen, the estimate is consistently off by about ¼ of a delay unit or more. For a delay of 40, a single frame would accumulate an error of one full sample, thus reducing the LTP efficiency. The estimated delay contour at frame m+1 shows an example of when the linear interpolation of the delay parameter cannot adequately resolve the variations present in the actual delay contour.

The RCELP algorithm, as discussed previously, can gain back some efficiency by modifying the residual to match the delay contour, but there are limitations to the algorithm which can limit subsequent performance. For example, shifting the residual signal to match the delay contour can only occur during special instances, i.e., when the localized residual energy is low. These instances, however, become less likely with high frequency talkers because the relative spacing between pitch periods is shorter; therefore, there is less opportunity to perform the shifting operations. There is also a maximum limit on the total accumulated shift allowed, which can result in artifacts when the limit is reached. This is especially of concern when it is desirable to reduce the algorithmic delay, because the maximum allowable accumulated shift is partially a function of the look-ahead length.

Since algorithmic delay (which is defined as the time in which a given input sample is represented at the output) is so important, it is desirable to reduce length of the look-ahead, thereby reducing the total algorithmic delay. For example, requirements for speech coding standards such as the Adaptive Multi-Rate (AMR) codec for Global Systems for Mobile Communications (or GSM) state that the algorithmic delay cannot exceed the frame length plus 5 ms. This corresponds to a look-ahead of 40 samples. For the prior art speech coder described herein, the pitch analysis window must be shifted left (or back in time). The problem with this situation is that the pitch analysis window is no longer centered at the end of the current frame, but only at the ¾ mark in the frame (sample 120 of 160). This, at best, leads to a discontinuous estimate of the delay contour. The problem associated with the discontinuities in the delay contour is that it is impossible to obtain the quality of speech that could otherwise be obtained with the increased look-ahead version of the equivalent algorithm.

In accordance with the preferred embodiment of the invention, a more accurate estimate of the delay contour is produced which results in a more accurate mapping of the LP residual signal $\epsilon(n)$ to the delay contour. This is accomplished as follows.

In the prior art, which in this case is speech encoding as defined in TIA document IS-127, the delay interpolation matrix d is used for establishing the endpoints for the interpolation of the delay on a subframe basis, as follows:

$$d(m', j) = \begin{cases} \tau(m); & |\tau(m) - \tau(m-1)| > 15, \\ (1 - f(m' + j))\tau(m-1) + f(m' + j)\tau(m); & \text{otherwise}, \end{cases} \quad (2)$$

$$0 \le m' < 3,\ 0 \le j < 3,$$

where $\tau(m)$ is the delay estimate for the current frame, $\tau(m-1)$ is the delay estimate for the previous frame, m' is the current subframe, and j is the index for the beginning, end, and the extension portions of the interpolation points. This is represented by Eq. 4.5.4.5-1 in IS-127. In addition, the interpolation coefficients are given by:

$$f=\{0.0,0.3313,0.6625,1.0,1.0\} \quad (3)$$

which reflect the 0/160, 53/160, (53+53)/160, and 160/160 endpoint fractions for each subframe interpolation. This is represented by Eq. 4.5.4.5-2 in IS-127. The duplication of the 1.0 on the end is due to the extension of the estimate to beyond the end of the frame. The delay contour for each subframe is then calculated as a strict linear interpolation on a per sample basis as:

$$\tau_c(n) = \begin{cases} d(m', 0) + \dfrac{n[d(m', 1) - d(m', 0)]}{L}; & 0 \le n < L, \\ d(m', 1) + \dfrac{(n - L)\,[d(m', 2) - d(m', 1)]}{L}; & L \le n < (L + 10), \end{cases} \quad (4)$$

where L is the subframe size. This is represented by Eq. 4.5.5.1-1 in IS-127.

In accordance with the present invention, the delay contour is adjusted on a subframe basis to allow a refined, higher resolution estimate of the true delay contour. The process of adjusting the endpoints on a subframe basis consists of a minimization procedure which involves the accumulated shift $\tau_{acc}$. Basically, the accumulated shift changes as a result of a non-optimal warping of the past modified residual signal, as defined in Eq. 4.5.6.1-1 of IS-127, which is used to generate the current residual target signal. If the input short-term residual signal $\epsilon(n)$ does not sufficiently match the target residual signal $\hat{\epsilon}_t(n)$, which is a function of the delay contour, then the residual signal must be shifted to match the delay contour. Excessive shifting, however, is an indicator that the delay contour is not being estimated properly, which can produce degraded sound quality. Therefore, the present invention improves sound quality by adjusting the delay contour to minimize the change in accumulated shift in accordance with the invention. Furthermore, the method for determining the adjusted delay contour incorporates a bias toward reducing the absolute value of the accumulated shift if it is not possible to hold the accumulated shift at a constant value.

Figure 4:
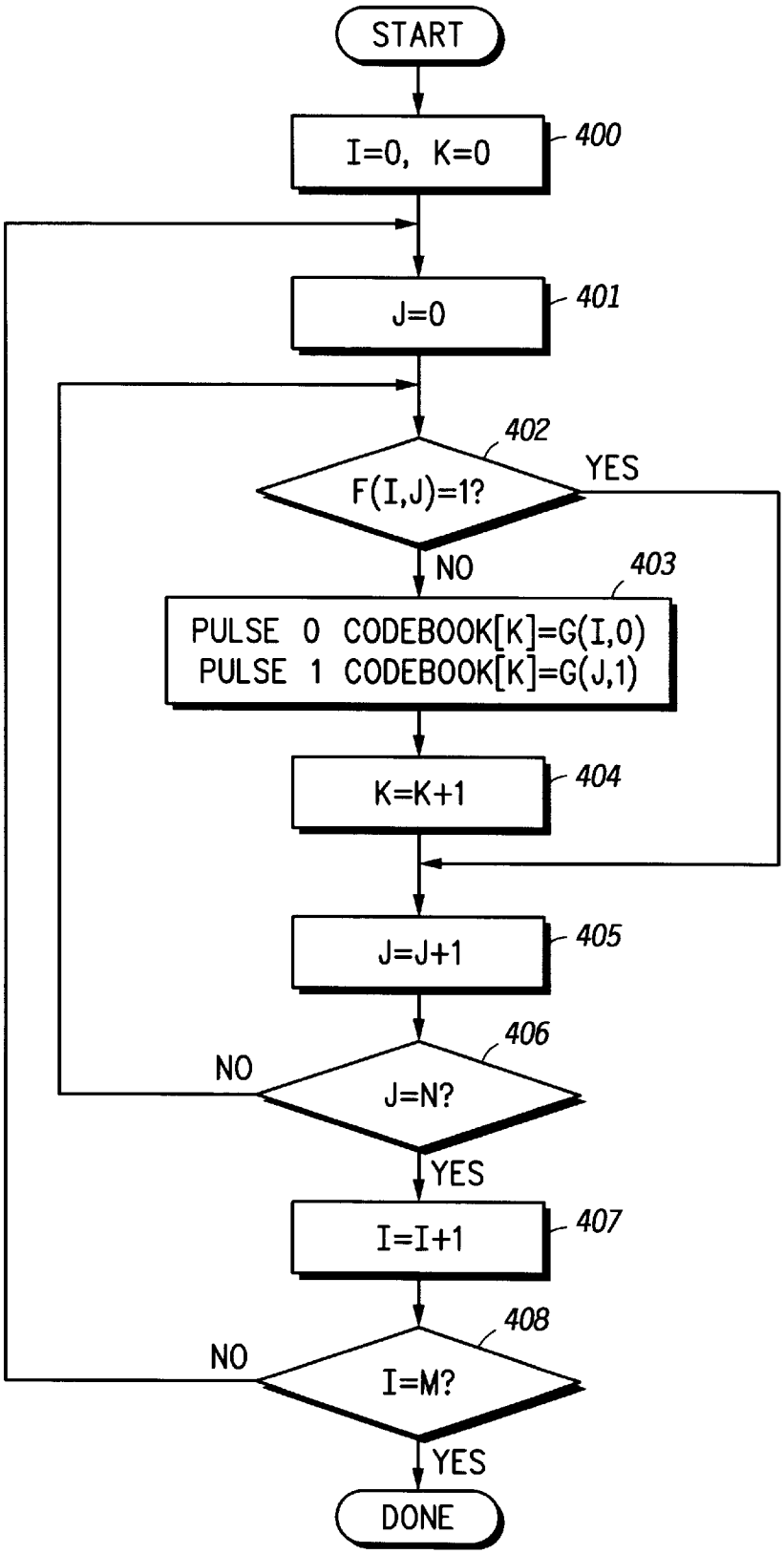
FIG. 4 generally depicts a flow chart of the delay contour adjustment process in accordance with the invention.

FIG. 4 generally depicts a flow chart of the delay contour adjustment process in accordance with the invention. As part of the adjusted delay contour computation, the process first calculates the delay of the current frame at step 301 as known in the prior art and described in section 4.2.3 of IS-127. Alternatively, the method described in U.S. patent application Ser. No. 09/086,509, titled "Method and Apparatus for Estimating the Fundamental Frequency of a Signal," and assigned to the assignee of the present invention, and incorporated herein by reference may also be beneficially employed to perform step 301. The delay contour endpoints are then calculated at step 302 for the current subframe m' by the conditional linear interpolation given in the following expressions, which are similar to Eq. (2) above:

$$d(0, j) = \begin{cases} \tau(m), & |\tau(m) - \tau(m-1)| > 15 \\ (1 - f(j)) \cdot (\tau(m-1) + \Delta_{adj}) + f(j)\tau(m), & \text{otherwise} \end{cases} \quad (5)$$

$$0 \le j < 3,$$

and $$d(m', j) = \begin{cases} \tau(m) + \Delta_{adj}, & |\tau(m) - \tau(m-1)| > 15 \\ d(m' - 1, j + 1) + \Delta_{adj}, & |\tau(m) - \tau(m-1)| \le 15 \text{ and } 0 \le j < 2 \\ (1 - f(m' + j))\tau(m-1) + f(m' + j)\tau(m) + \Delta_{adj}, & \text{otherwise} \end{cases} \quad (6)$$

$$1 \le m' < 3,$$

where $\Delta_{adj}$ is the delay adjustment factor for the previous subframe, and is calculated at steps 305–310 for the current subframe. The initial value of the delay adjustment factor is zero. The fundamental differences between Eq. (2) and Eqs. (5) and (6) are:

(a) For the first subframe (m'=0, Eq. (5)), the end points for the interpolation are $[\tau(m-1)+\Delta_{adj}, \tau(m)]$ and not $[\tau(m-1), \tau(m)]$. This allows for delay adjustment continuity from frame to frame.

(b) For subframes other than the first ($1 \leqq m' < 3$, Eq. (6)) and when the frame delay changes by a large margin, the default delay value is $\tau(m)+\Delta_{adj}$ and not $\tau(m)$.

(c) For subframes other than the first ($1 \leqq m' < 3$, Eq. (6)) and when the frame delays are within the interpolation limits, the delay endpoints are globally shifted by the previous delay adjustment value.

The delay increment factor $\delta(m')$ for the current subframe m' is then calculated at step 303 according to the following expression:

$$\delta(m') = \alpha\left(\frac{d(m', 0) + d(m', 1)}{2}\right) \quad (7)$$

where $\alpha=0.007$ is the step size constant. This expression yields an increment factor that is proportional to the average subframe delay.

Next, the delay adjustment bias selector b is calculated at step 304 according to the following expression:

$$b = \begin{cases} 1, & \tau(m) > \tau(m-1) \\ 0, & \text{otherwise} \end{cases} \tag{8}$$

The purpose of the bias selector b is to allow more quantization levels for the delay adjustment factor based on the delay trajectory. For example, in the preferred embodiment, the delay adjustment parameter comprises two bits per subframe, which corresponds to four distinct delay adjustment values. Using the bias selector, the values for the delay adjustment candidates can be:

$$\Delta_{adj}(b) \in \{[0,-\delta,\delta,-2\delta],[0,\delta,-\delta,2\delta]\}, \tag{9}$$

such that a bias selector of b=0 uses values that are biased toward negative adjustment, and a bias selector of b=1 uses values that are biased toward positive adjustment. There are two advantages to this scheme. First, an adjustment of 0 can always be represented, meaning that the delay contour is sufficiently accurate without a forced adjustment. Second, the bias can be set such that the dynamic range is greater towards values with higher probability. That is, a delay of $\tau(m)>\tau(m-1)$ indicates an upward trend in the delay contour. Therefore, a bias of b=1 would be chosen to allow greater dynamic range on the positive side to more accurately represent the upward trend in delay, i.e., $\Delta_{adj} \in \{0, \delta, -\delta, 2\delta\}$. Similar logic is used for downward trends.

Steps 305–310 relate to the determination of the optimal delay adjustment factor, which generally comprises a procedure which minimizes the change in accumulated shift for a given subframe of information in accordance with the invention. Each of the candidate delay contours is calculated at step 305 according to the following expression, which is similar to Eq. (4) above:

$$\tau_c(n) = \begin{cases} d(m',0) + \dfrac{n[d(m',1)-d(m',0)]}{L} + \Delta_{adj}(b); & 0 \le n < L, \\ d(m',1) + \dfrac{(n-L)[d(m',2)-d(m',1)]}{L} + \Delta_{adj}(b); & L \le n < (L+10), \end{cases} \tag{10}$$

but where $\Delta_{adj}(b)$ has elements described in Eq. (9) above. Once a candidate delay contour is computed, the accumulated shift is updated at step 306 as described in the prior art, specifically section 4.5.6 of IS-127 titled "Modification of the Residual". Subsequently, the parameters associated with the minimum change in accumulated shift are saved at steps 307–309, and the processing loop is terminated upon all adjusted delay contour candidates being exhausted at step 310.

Once the optimal subframe delay contour is found, the table index corresponding to the optimal delay adjustment $\Delta_{adj}(b)$ is transmitted to the decoder at step 311, and the remainder of the subframe encoding process is performed, which include modification of the residual at step 312 and generation of the adaptive codebook contribution at step 313. The process is then repeated for the remaining subframes, as indicated at step 314.

Here, it is important to note that for a given subframe of information, it may be possible that all adjusted delay contour candidates from Eq. (10) produce an identical change in accumulated shift. In this case, an adjustment of zero is selected because of the ordering of the search candidates. As can be seen in Eq. (9), the value of $\Delta_{adj}(b)=0$ is tested first, and the minimization is structured such that the subsequent candidates must reduce the absolute change in accumulated shift in order to be selected. Also notice that the candidates are ordered to start at zero, and progressively increase in absolute value. This forms a bias toward keeping the absolute change in delay adjustment at a minimum value. Furthermore, the preferred embodiment implements additional minimization logic in step 307, such that if two adjusted delay contour candidates result in the same absolute change in accumulated shift, but of opposite polarity, the delay adjustment candidate that lowers the absolute accumulated shift is selected. As an example, if the current accumulated shift is 5, and the adjustments of $\Delta_{adj} \in \{0, \delta\}$ result in a change of accumulated shift of +1 and −1, respectively, then the value of $\Delta_{adj}=\delta$ would be chosen because the net accumulated shift would be 4 instead of 6. This bias towards minimizing absolute accumulated shift improves speech quality by lowering the probability of saturating the shift buffer (as described in the background), and also by minimizing the skew between the original and modified speech.

Figure 5:
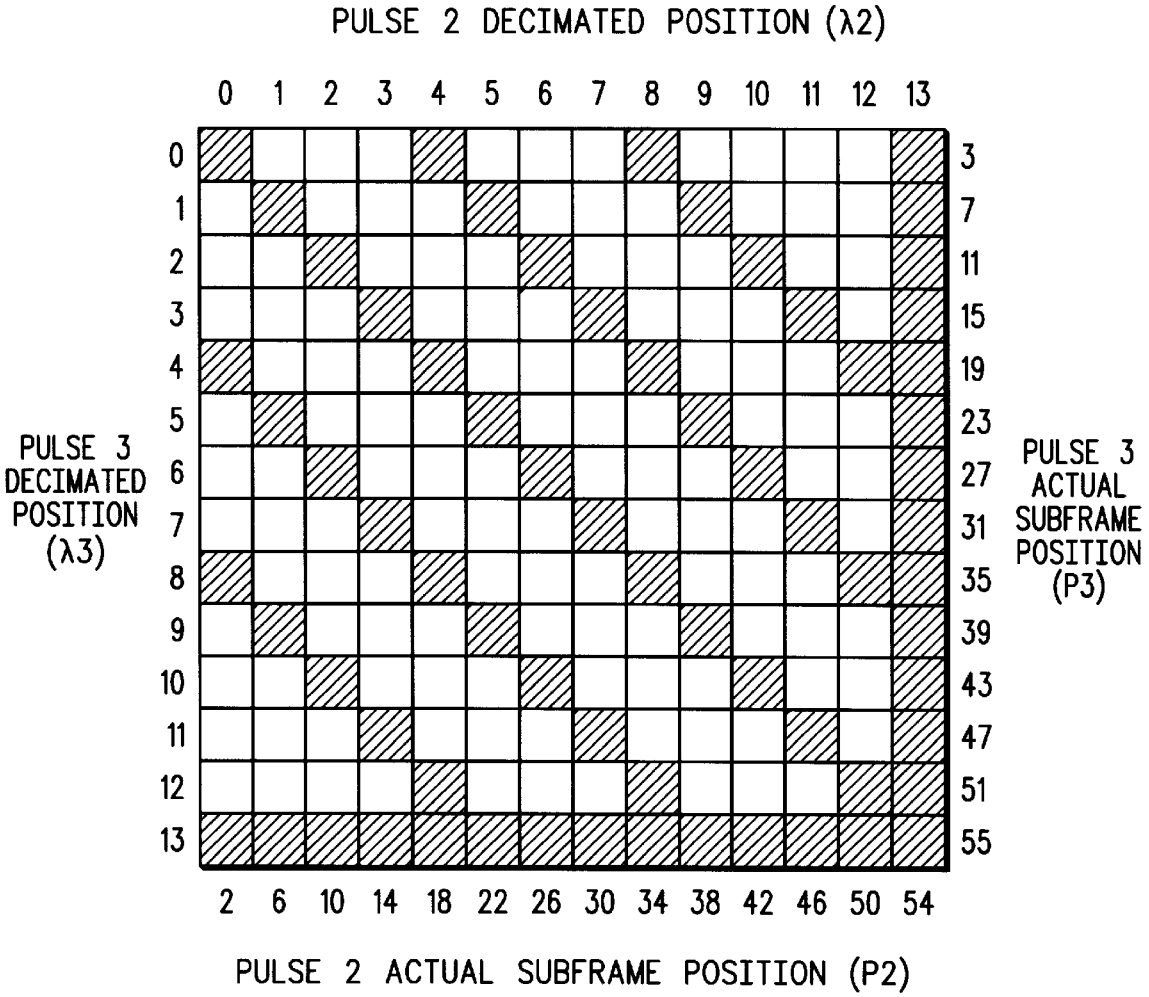
FIG. 5 generally depicts the decoding and delay contour reconstruction process in accordance with the invention.

The process of decoding and delay contour reconstruction in accordance with the invention is shown in FIG. 5. This process comprises many of the functional blocks as described above with reference to the encoding process of FIG. 4, except that the minimization procedure is not implemented. All that is needed is the delay and delay adjustment index to reconstruct the adjusted delay contour exactly as done in the coder. The process shown in FIG. 5 begins when a frame delay is received from the coder at step 401. Delay contour endpoints are calculated at step 402 and a delay increment factor is then calculated at step 403. At step 404, a delay adjustment bias is calculated and the delay adjustment index, represented by the signal delay information in FIG. 2, is received from the coder at step 405. An adjusted delay contour $\tau_c(n)$ is calculated at step 406 and an adaptive codebook contribution using the adjusted delay contour $\tau_c(n)$ is generated at step 407. At step 408, the decoder looks for more subframes to decode and the process is repeated.

Figure 6:
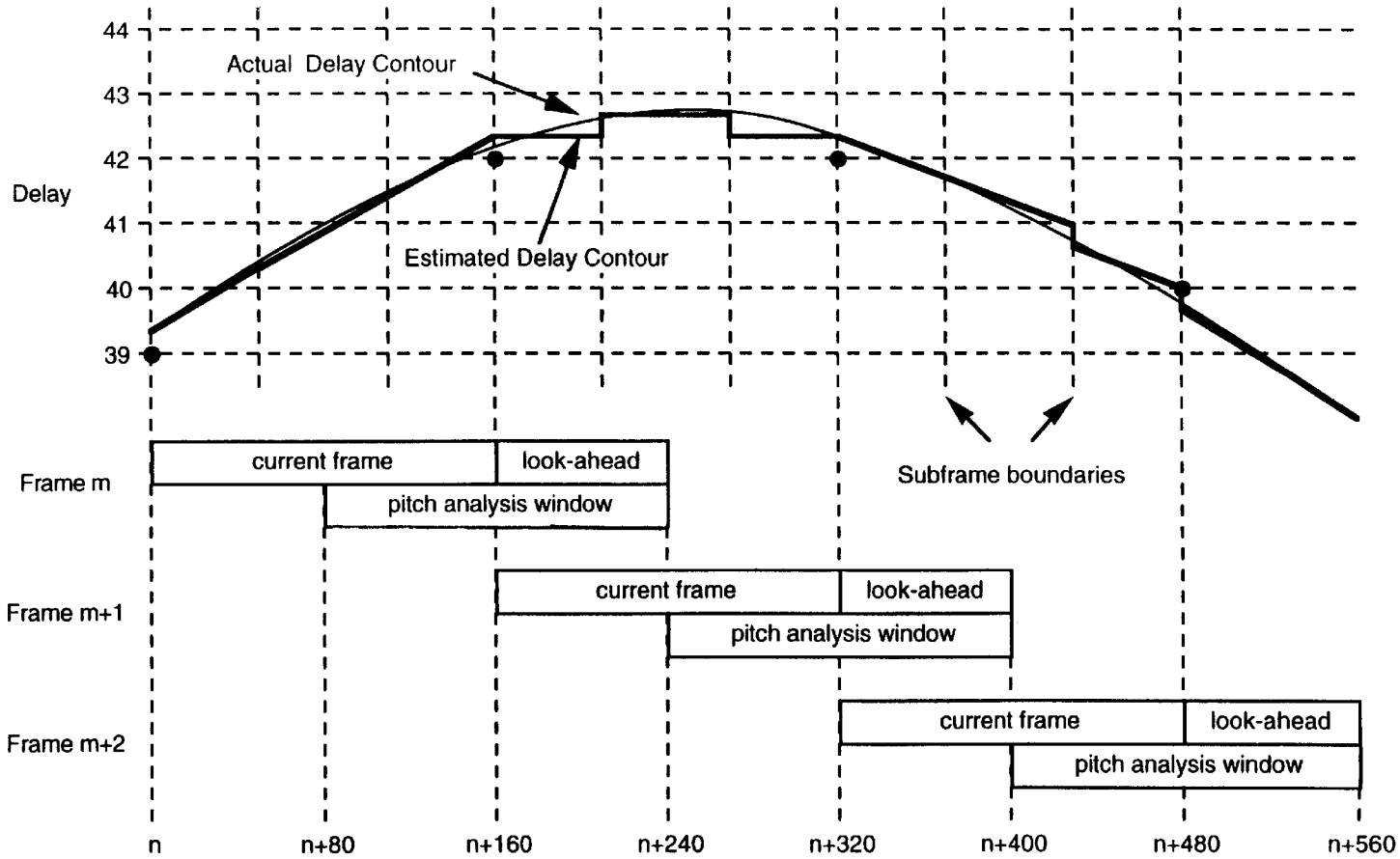
FIG. 6 generally illustrates the results of the contour delay adjustment process in accordance with the invention.
Figures 1, 2:
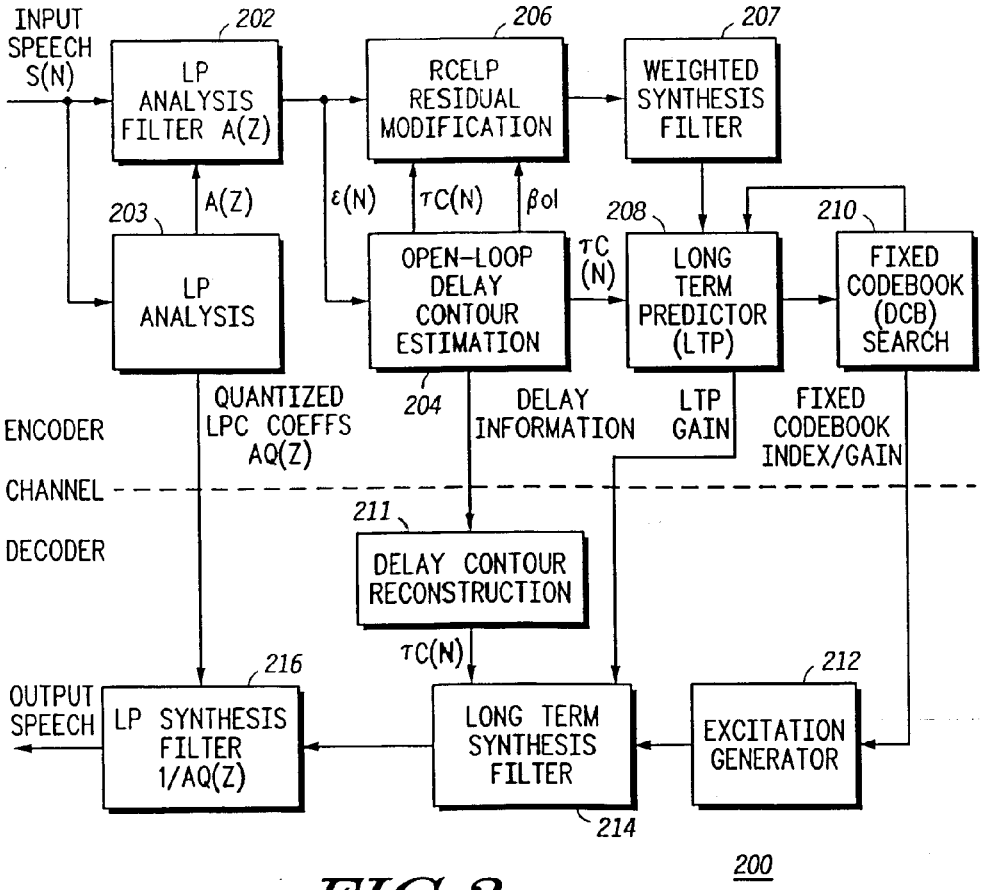
Figure 3:
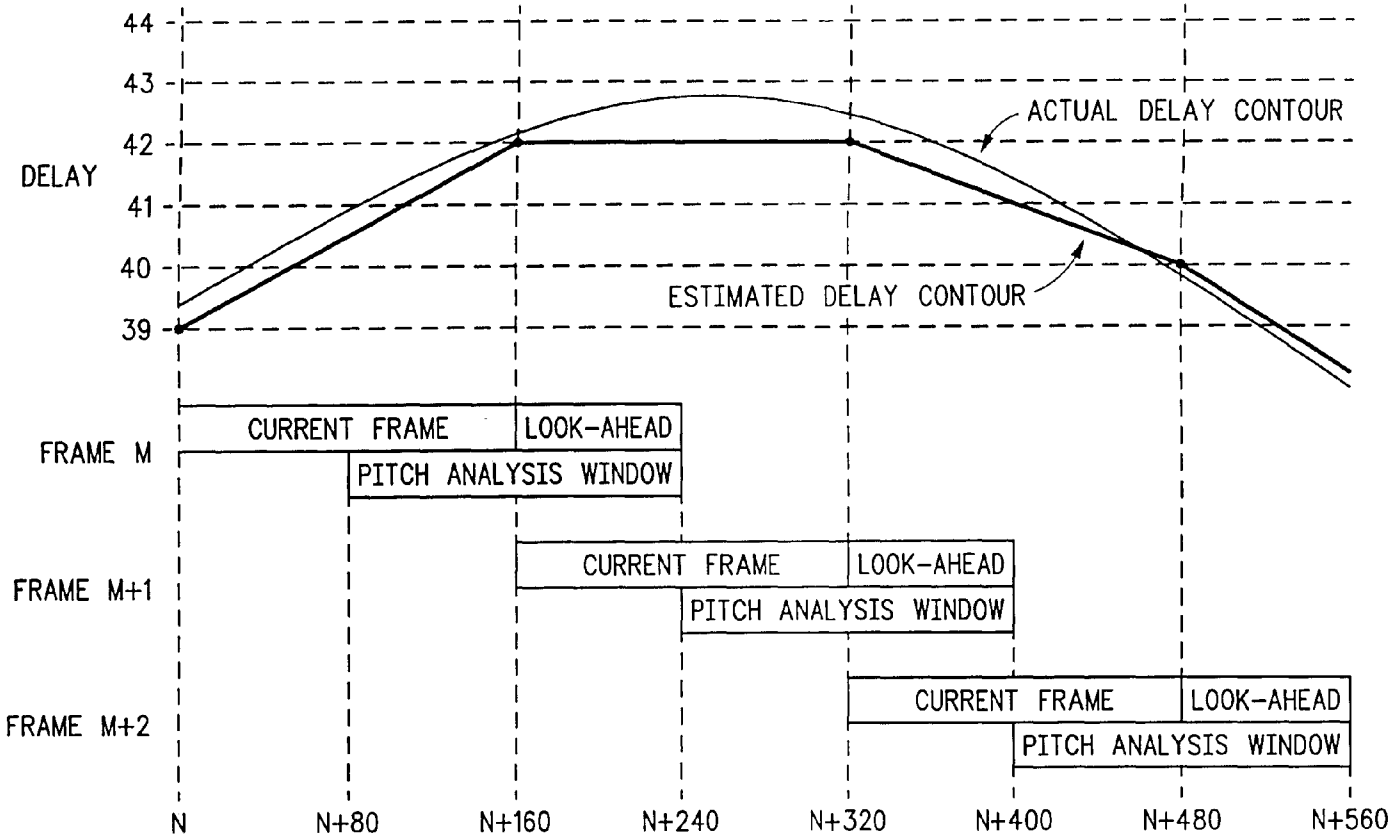
Figure 4:
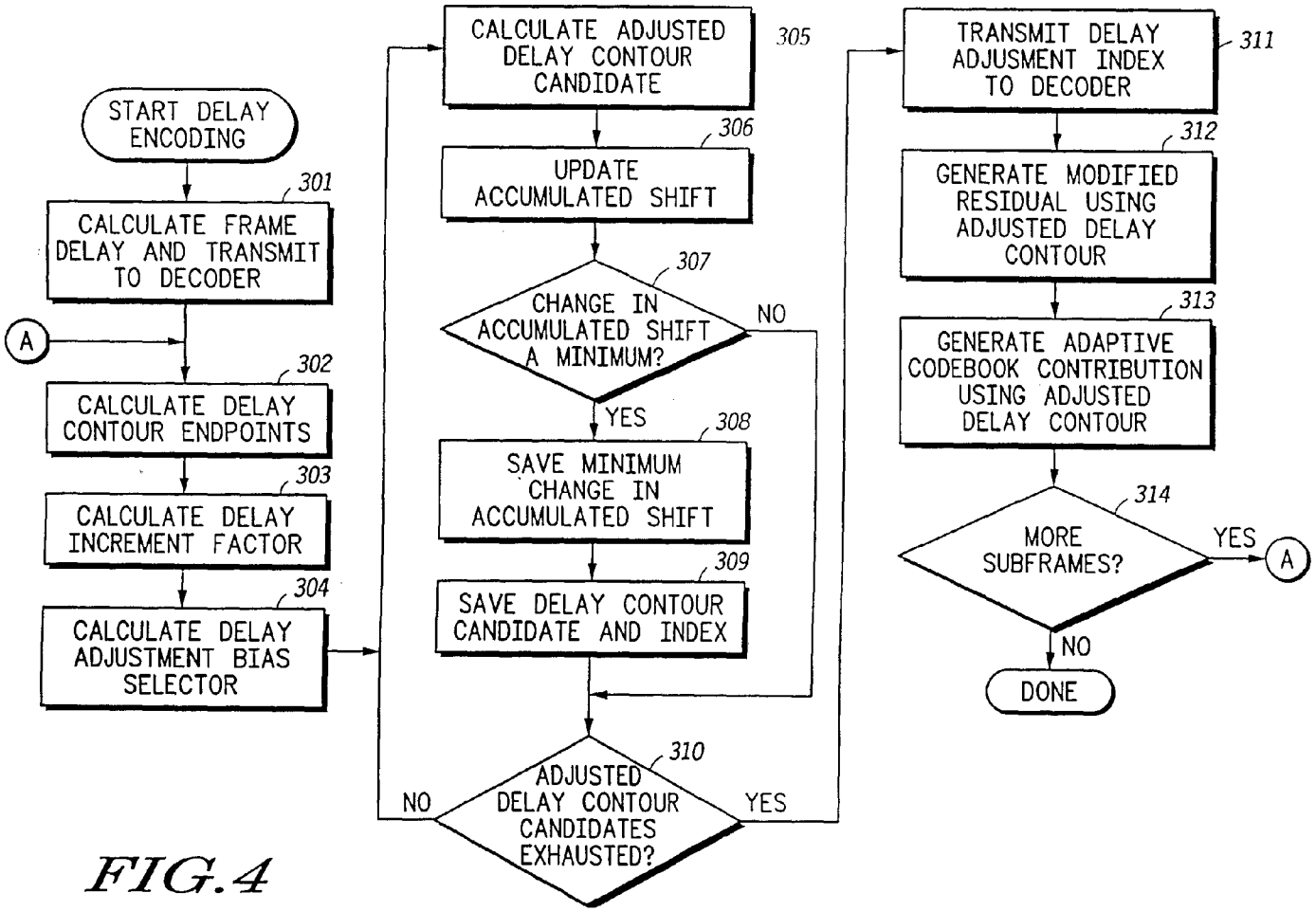
Figure 5:
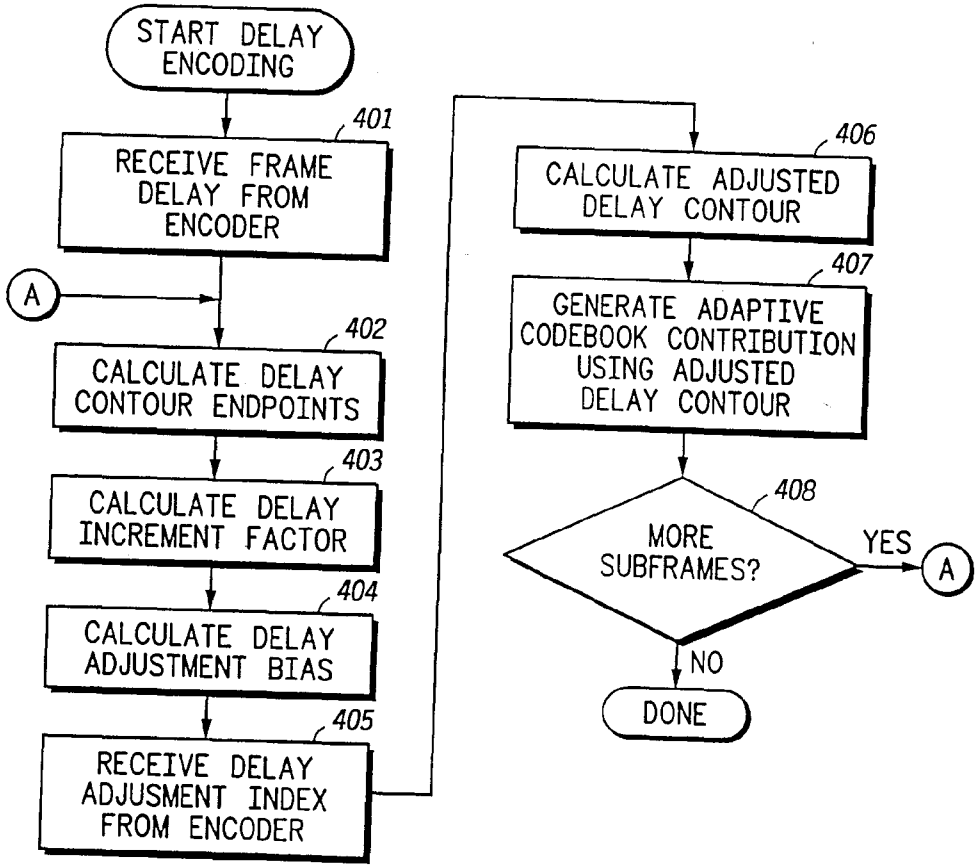
Figure 6:
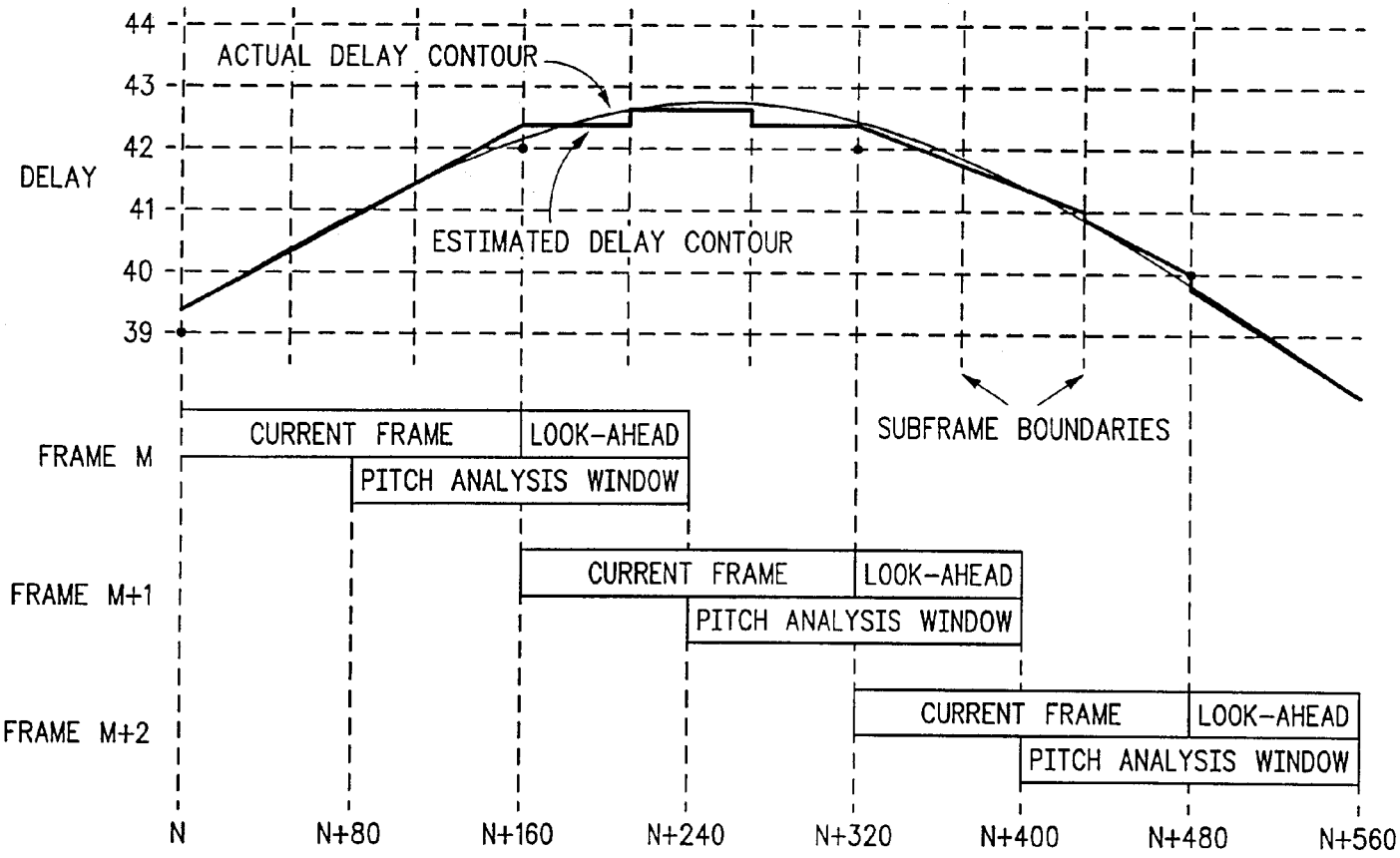

FIG. 6 generally illustrates the results of the contour delay adjustment process in accordance with the invention. When compared to the prior art delay contour of FIG. 3, it is apparent that the present invention tracks the actual delay contour with higher resolution and accuracy. One significant difference between the present invention and other subframe resolution delay encoding techniques (such as GSM half rate) is that the present invention retains the delay contour slope due to the linear interpolation. Other techniques that utilize subframe resolution represent only constant delay values.

It is also important to note that during the minimization procedure, it is specified to execute section 4.5.6 of IS-127 to determine the updated accumulated shift. Since this process is of relatively high complexity, it would be an advantage to compute only those terms which are necessary to produce the desired result, and omit unnecessary computations. Also, it may be possible to use alternate selection criteria, such as the maximization of the cross correlation between the target residual signal (see Eq. (4.5.6.1-1) in IS-127) and the subframe residual signal (Eq. (4.5.6.2-1) in IS-127). Furthermore, other methods may adjust the delay contour in various ways to improve upon a particular circumstance. Such a method, for example, may include (but is not limited to) adjusting only a single endpoint of the subframe delay, rather than adjusting both endpoints as described in the preferred embodiment. Other methods may also include higher order curve fitting, such as least squares or other polynomial based techniques.

While the invention has been particularly shown and described with reference to a particular embodiment, it will be understood by those skilled in the art that various changes in form and details may be made therein without departing from the spirit and scope of the invention. All of the above mentioned variations to the preferred embodiment are therefore considered to be within the scope of the invention. The corresponding structures, materials, acts and equivalents of all means or step plus function elements in the claims below are intended to include any structure, material, or acts for performing the functions in combination with other claimed elements as specifically claimed.

What we claim is:

1. A method for coding an information signal comprising the steps of:

a) dividing the information signal into blocks;

b) estimating the delay of the current and previous blocks of information;

c) forming a delay contour based on the delays of the current and previous blocks of information;

d) adjusting the shape of the delay contour at intervals of less than or equal to one block in length;

e) coding the shape of the adjusted delay contour to produce codes suitable for transmission to a destination.

2. The method in claim 1 wherein the information signal further comprises either a speech or an audio signal.

3. The method in claim 1 wherein the blocks of information signals further comprise frames of information signals.

4. The method in claim 1 wherein a linear interpolation between the previous delay and the current delay is used to form the delay contour.

5. The method in claim 1 wherein the interval of less than one block in length further comprises a subframe in length.

6. The method in claim 1 wherein the step of adjusting the shape of the delay contour at intervals of less than or equal to one block in length further comprises the steps of:

a) determining the adjusted delay at a point at or between the current and previous delays; and b) forming a linear interpolation between the previous delay point and the adjusted delay point.

7. The method in claim 6 wherein a change in accumulated shift is minimized when determining the adjusted delay point.

8. The method in claim 7 wherein minimizing the change in accumulated shift further comprises a bias toward minimizing the accumulated shift.

9. The method in claim 6 wherein the step of determining the adjusted delay further comprises the step of maximizing the correlation between a target residual signal and the original residual signal.

10. The method in claim 6 wherein the previous delay point further comprises a previously adjusted delay point.

11. The method in claim 1 wherein the step of adjusting the shape of the delay contour further comprises the steps of:

a) determining a plurality of adjusted delay points at or between the current and previous delays; and b) forming a linear interpolation between the adjusted delay points.

12. The method in claim 11 wherein a change in accumulated shift is minimized when determining the adjusted delay point.

13. The method in claim 12 wherein minimizing the change in accumulated shift further comprises a bias toward minimizing the accumulated shift.

14. The method in claim 11 wherein the step of determining the adjusted delay further comprises the step of maximizing the correlation between a target residual signal and the original residual signal.

15. A system for coding an information signal, the system including an coder comprising:

means for dividing the information signal into blocks;

means for estimating the delay of the current and previous blocks of information and for forming a delay contour based on the delays of the current and previous blocks of information to adjust the shape of the delay contour at intervals of less than or equal to one block in length to produce delay information for transmission to a decoder.

16. The system of claim 15 wherein the information signal further comprises either a speech or an audio signal.

17. The system of claim 15 wherein the blocks of information signals further comprise frames of information signals.

18. The system of claim 15 wherein a linear interpolation between the previous delay and the current delay is used to form the delay contour.

19. The system of claim 15 wherein the interval of less than one block in length further comprises a subframe in length.

20. The system of claim 15 wherein the delay information further comprises a delay adjustment index.

21. The system of claim 15, further comprising a decoder for receiving the delay information and for producing an adjusted delay contour $\tau_c(n)$ for use in reconstructing the information signal.

* * * * *

UNITED STATES PATENT AND TRADEMARK OFFICE

CERTIFICATE OF CORRECTION

PATENT NO. : 6,113,653
DATED : September 5, 2000
INVENTOR(S) : James P. Ashley et al.

It is certified that error appears in the above-identified patent and that said Letters Patent is hereby corrected as shown below:

Title page,
The title page showing the illustrative figure should be deleted and substitute therefore the attached title page.

Drawings,
Sheets 1-5, consisting of Figs. 1-6, should be deleted to be replaced with the correct Figs. 1-6, as shown on the attached pages.

Signed and Sealed this

Twenty-third Day of July, 2002

*Attest:*

*Attesting Officer*

JAMES E. ROGAN
*Director of the United States Patent and Trademark Office*

United States Patent [19]

Ashley et al.

[11] Patent Number: 6,113,653

[45] Date of Patent: Sep. 5, 2000

[54] METHOD AND APPARATUS FOR CODING AN INFORMATION SIGNAL USING DELAY CONTOUR ADJUSTMENT

[75] Inventors: James P. Ashley, Naperville; Weimin Peng, Mundelein, both of Ill.

[73] Assignee: Motorola, Inc., Schaumburg, Ill.

[21] Appl. No.: 09/151,567

[22] Filed: Sep. 11, 1998

[51] Int. Cl.[7] ..... G10L 9/14

[52] U.S. Cl. ..... 784/219; 704/207; 704/216

[58] Field of Search ..... 704/207, 216, 704/219

[56] References Cited

U.S. PATENT DOCUMENTS 5,704,003 12/1997 Kleijn et al. ..... 704/220

OTHER PUBLICATIONS

Dror Nahumi and Willem Bastiaan Kleijn, "An Improved 8 Kb/s RCELP Coder," Proc. IEEE Workshop on Speech Coding for Telecommunications, p. 39–40, Sep. 1995.

*Primary Examiner*—Richemond Dorvil
*Assistant Examiner*—Tālivaldis Ivars Šmits
*Attorney, Agent, or Firm*—Richard A. Sonnentag

[57] ABSTRACT

An open-loop delay contour estimator (204) generates delay information during coding of an information signal. The delay contour is adjusted according to an error minimization criterion on a subframe basis, which allows a more precise estimate of the true delay contour. A delay contour reconstruction block (211) uses the delay information in a decoder in reconstructing the information signal.

21 Claims, 5 Drawing Sheets

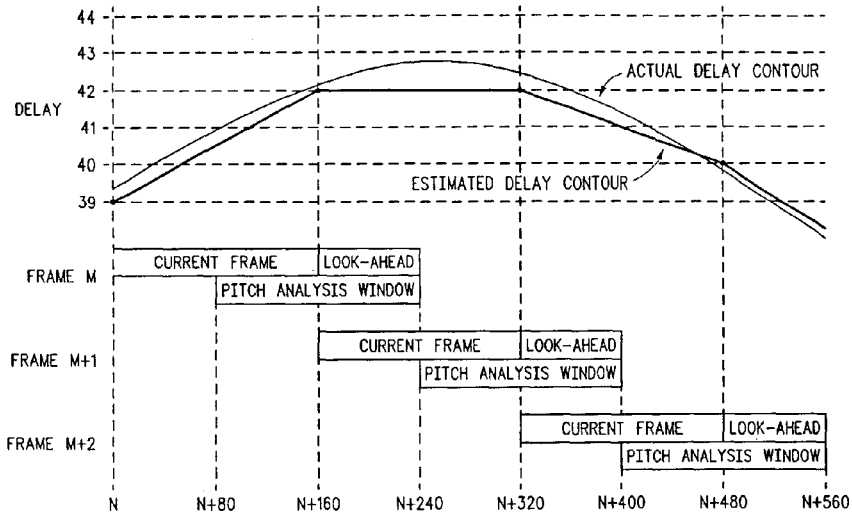

| LAG RANGE | LAG RESOLUTION | NUMBER IN RANGE |
|---|---|---|
| 21 TO 22-2/3 | 1/3 | 6 |
| 23 TO 34-5/6 | 1/6 | 72 |
| 35 TO 49-2/3 | 1/3 | 45 |
| 50 TO 89-1/2 | 1/2 | 80 |
| 90 TO 142 | 1 | 52 |

-PRIOR ART-